US008704118B2

(12) United States Patent
Konno

(10) Patent No.: US 8,704,118 B2
(45) Date of Patent: Apr. 22, 2014

(54) SWITCH DEVICE

(75) Inventor: Satoru Konno, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 205 days.

(21) Appl. No.: 13/404,767

(22) Filed: Feb. 24, 2012

(65) Prior Publication Data

US 2012/0217144 A1 Aug. 30, 2012

(30) Foreign Application Priority Data

Feb. 25, 2011 (JP) ..... 2011-039727

(51) Int. Cl.
*H01H 3/00* (2006.01)
*H01H 13/00* (2006.01)

(52) U.S. Cl.
USPC ..... 200/339

(58) Field of Classification Search
USPC ..... 200/339, 416, 447, 464, 520, 537, 538, 200/553, 573, 303, 333
See application file for complete search history.

(56) References Cited

U.S. PATENT DOCUMENTS 3,339,041 A 8/1967 Rogero
3,681,556 A * 8/1972 Osika ..... 200/338
4,121,068 A * 10/1978 Peck ..... 200/437
4,440,994 A * 4/1984 Nat ..... 200/43.04
5,285,039 A 2/1994 Satoh
6,040,543 A 3/2000 Mina et al.
7,026,565 B1 * 4/2006 Lee ..... 200/339
2008/0035457 A1 2/2008 Nakamura et al.

FOREIGN PATENT DOCUMENTS

DE 1665430 2/1971
JP 2007-265740 10/2007

OTHER PUBLICATIONS

Extended European Search Report issued in corresponding European Patent Application No. 12154717.8, mailed Jun. 4, 2012.

* cited by examiner

*Primary Examiner* — Edwin A. Leon
*Assistant Examiner* — Anthony R. Jimenez
(74) *Attorney, Agent, or Firm* — Brinks Gilson & Lione

(57) ABSTRACT

A switch device includes a rockable operating body held in a case, a driving body held within the case and made rockable by the operating body, and a switch element pressed by the driving body. The rockable operating body is held with respect to the case by a first rotating portion apart by a predetermined distance from a position where the operating body is operated. The rockable driving body is held with respect to the case by a second rotating portion apart by predetermined distance from a position where the driving body presses the switch element. A rocking portion that makes the operating body and the driving body rockable relative to each other between the first rotating portion and the second rotating portion is constituted by the operating body and the driving body.

4 Claims, 2 Drawing Sheets

SWITCH DEVICE

CLAIM OF PRIORITY

This application claims benefit of Japanese Patent Application No. 2011-039727 filed on Feb. 25, 2011, which is hereby incorporated in its entirety by reference.

BACKGROUND

1. Field of the Invention

The present disclosure relates to a switch device that performs a switching operation by a operating body is held in a case made rockable, and particularly, to a switch device that performs a switching operation via a driving body in cooperation with the operating body.

2. Description of the Related Art

In automobiles, a switch device including a rockable operating body is used as a switch for operating a power window or a switch of a parking brake. Such a switch device is known in which a rockable operating body is provided in a case, a driving body that moves up and down with the rocking of the operating body is provided within the case, and a switch element is provided so as to face the driving body.

In this case, if the operating body is operated so as to be rocked, the driving body moves down to press the switch element, thereby performing a switching operation. If the operation state is released, the driving body and the operating body can return to their original state by the restoring force of the switch element. As such a switch device, for example, there is a switch device as mentioned in Japanese Unexamined Patent Application Publication No. 2007-265740.

A switch element including two switching contacts that are simultaneously turned on and off is used as the switch device used for a parking brake. In this case, if the switch element is pressed and operated by a rocking operation of the operating body, the two switching contacts can be simultaneously switched. This allows a reliable operation even if there is an abnormality in any one of the switching contacts. If the outputs from the two switching contacts are detected within a predetermined time (for example, 100 ms), a control unit on the vehicle side determines this to be normal. Accordingly, with the rocking operation of the operating body, it is necessary to allow the two switching contacts in the switch element to be reliably switched within the predetermined time.

In the related-art switch device used for a power window, the driving body does not operate at very high speed because the rocking speed of the operating body and the up-down movement speed of the driving body are almost the same. For this reason, when the switch element is pressed, there is a concern that a time difference may be caused in the switching of the two switching contacts, and an abnormality may be erroneously detected even though there is not abnormality in the switch element. Since such a problem does not occur if the driving body presses the switch element at high speed, a switch device in which the driving body can operate at higher speed than the operating body is desired.

SUMMARY

A switch device includes a operating body held in a case and made rockable; a driving body held within the case and made rockable by the operating body; and a switch element pressed by the driving body. The rockable operating body is held with respect to the case by a first rotating portion apart by a predetermined distance from a position where the operating body is operated. The rockable driving body is held with respect to the case by a second rotating portion apart by predetermined distance from a position where the driving body presses the switch element. A rocking portion that makes the operating body and the driving body rockable relative to each other between the first rotating portion and the second rotating portion is constituted by the operating body and the driving body.

DESCRIPTION OF THE EXEMPLARY EMBODIMENTS

Figure 1:
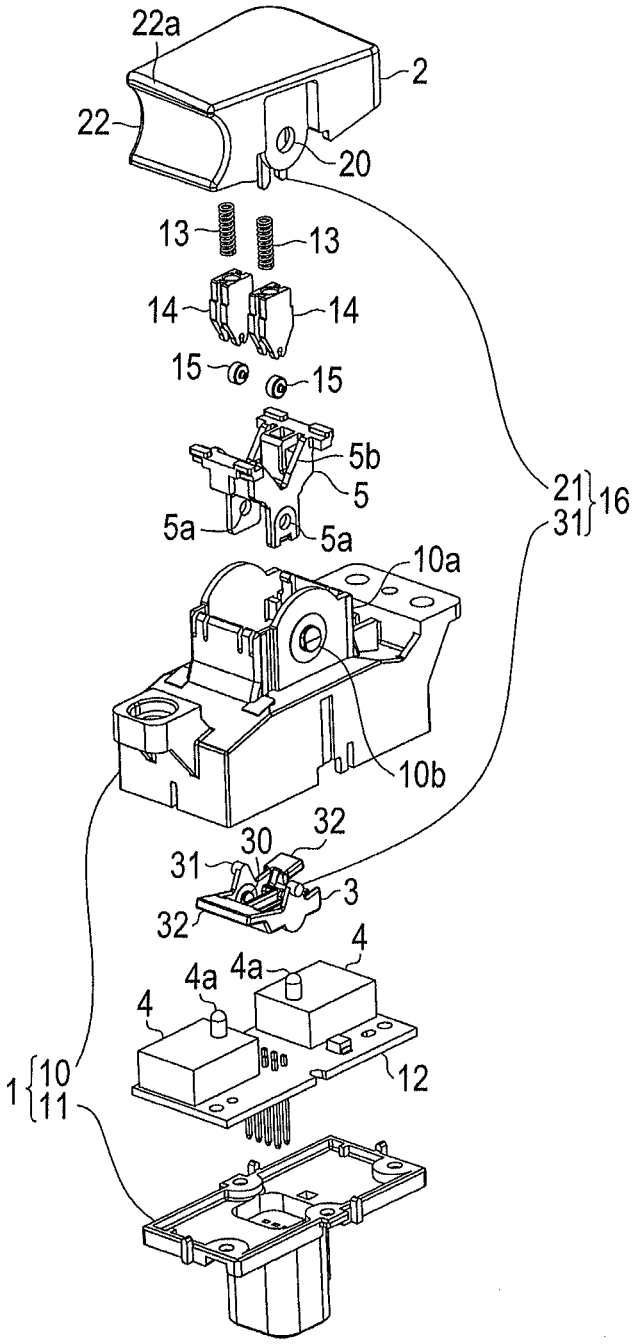
FIG. 1 is an exploded perspective view of a switch device in the present embodiment.

An embodiment of the present invention will be described in detail with reference to the drawings. An exploded perspective view of a switch device in the present embodiment is shown in FIG. 1. As shown in this drawing, the switch device of the present embodiment is adapted such that a operating body 2 is attached to a case 1 and made rockable, including an upper case 10 and a lower case 11, and a board 12 on which two switch elements 4 are arranged is housed within the case 1, and one of the switch elements 4 is pressed and operated with the rocking operation of the operating body 2.

An operating body holding portion 10*a* holding the operating body 2 is formed in the upper case 10 constituting the case 1 so as to protrude upward. Projection-like shaft portions 10*b* are formed on both sides of the operating body holding portion 10*a*, respectively. Corresponding to this, hole-shaped first rotating portions 20 are formed also in both sides of the operating body 2, respectively, and the operating body 2 is made rockable about the first rotating portions 20 with respect to the case 1 by causing the shaft portions 10*b* to be inserted through the first rotating portions 20.

In the operating body 2, an operating portion 22 including a concave surface is formed in one of the surfaces that face each other adjacent to a pair of surfaces having the first rotating portions 20. As an operator hooks his/her finger on the operating portion 22 to pull the operating portion upward, the operating body 2 can be rocked in one direction (in the counterclockwise direction in FIG. 3). In the present embodiment, if an upper end position in a curved surface that constitutes the operating portion 22 is supposed to be an operation position 22*a* to which a force for rocking is applied, the operating body 2 can be rocked in the other direction by pushing in the vicinity of the operation position 22*a* with a finger.

The switch device is provided with a mechanism for giving a click feel with respect to the rocking of the operating body 2. Cam members 5 fixed to the inner surface of the upper case 10 and sliding members 14 attached to the operating body 2 via elastic members 13, respectively, constitute the mechanism for giving a click feel. A rolling cylindrical distal end member 15 is attached to a distal end portion of each sliding member 14.

The cam members 5 are provided with cam surface portions 5*b* that are upwardly inclined, respectively, toward both side portions from a central portion. Each cam surface portion 5*b* is formed with a point that changes in the angle of inclination on the way. Additionally, the sliding member 14 is biased in a direction in which the sliding member is pressed against the cam surface portion 5*b* by the elastic member 13, and the cam surface portion 5*b* can smoothly slide by the distal end member 15.

For this reason, if the operating body 2 is rocked, a biasing force to the sliding member 14 becomes a resistance force to a rocking operation, so that a moderate feeling of operation can be given. Additionally, a click feel can be given when the sliding member 14 passes through the point where the angle of inclination of the cam surface portion 5*b* changes.

Additionally, the cam member 5 has a hole-shaped pivot portion 5*a* at a lower portion thereof. A rockable driving body 3 is attached to the pivot portions 5*a*. As the rockable driving body 3 is attached to the cam members 5 fixed to the upper case 10, the driving body 3 is made rockable with respect to the case 1.

The driving body 3 has second rotating portions 30 inserted through the pivot portions 5*a*. The second rotating portions 30 are formed in the shape of projections that turn to the inside of the driving body 3, and is fitted to the pivot portions 5*a* from the external surface side of the pivot portions, and is made rotatable with respect to the case 1. In addition, although one second rotating portion 30 is illustrated in FIG. 1, the other second rotating portion is also similarly formed on the opposite surface that faces the one second rotating portion.

Additionally, the driving body 3 has projection-like shaft portions 31 above the second rotating portions 30. The shaft portions 31 are formed in the shape of projections that turn to the outside of the driving body 3. The operating body 2 has holding portions 21 formed substantially in the shape of the letter U below the first rotating portions 20. A rocking portion 16 that enables the driving body 3 to be rockable with respect to the operating body 2 is constructed by each shaft portion 31 of the driving body 3 through each holding portion 21. As such, the driving body 3 is rockable with respect to the case 1, and is also made rockable with respect to the operating body 2.

Moreover, pressing portions 32 are formed at the driving body 3 so as to extend respectively toward both side portions from a central portion where the second rotating portions 30 and the shaft portions 31 are formed. The pressing portions 32 are arranged to face the two switch elements 4 and 4 arranged on the board 12 so as to be able to press the switch elements, respectively. As the driving body 3 rocks with the rocking operation of the operating body 2, a pressing portion 32 presses a pressed portion 4*a* of one of the switch elements 4 on a lower surface thereof at the distal end.

Figure 2:
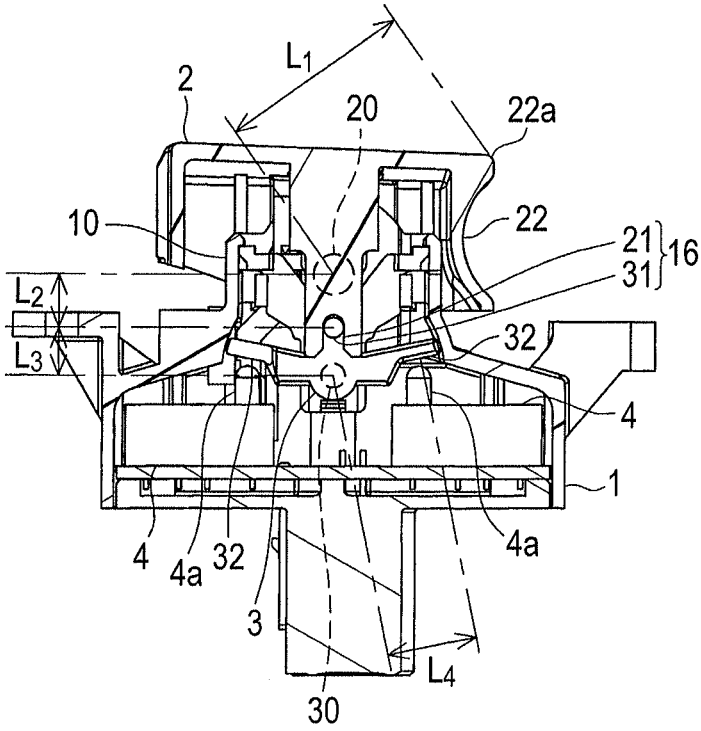
FIG. 2 is a cross-sectional view of the switch device.

A cross-sectional view of a switch device is shown in FIG. 2. FIG. 2 shows a state where the operating body 2 is at a neutral position where the operating body is rocked and operated. When the operating body 2 is in the neutral position, the driving body 3 is also in the neutral position, and both the pressing portions 32 are in a state where the pressing portions face the pressing portions 4*a* of the switch elements 4, respectively, in close proximity thereto.

When the operating body 2 is at the neutral position, the first rotating portion 20 of the operating body 2, the second rotating portion 30 of the driving body 3, and the rocking portion 16 are located on a straight line, and the rocking portion 16 is arranged at a position between the first rotating portion 20 and the second rotating portion 30.

In FIG. 2, the distance from the operation position 22*a* of the operating body 2 to the first rotating portion 20 is defined as $L_1$, the distance from the first rotating portion 20 to the rocking portion 16 is defined as $L_2$, the distance from the rocking portion 16 to the second rotating portion 30 of the driving body 3 is defined as $L_3$, and the distance from the second rotating portion 30 to the position where the pressed portion 4*a* of the pressing portion 32 is pressed is defined as $L_4$. These respective distances are determined in advance depending on the shape of the operating body 2 and the driving body 3.

In order to press the switch element 4 at as high a speed as possible in the pressing portion 32 of the driving body 3 with the operation of the operating body 2, it is necessary to make the rocking speed in the rocking portion 16 as high as possible, and make the rocking speed in the pressing portion 32 as high as possible. In order to make the rocking speed in the rocking portion 16 as high as possible, it is desirable that the ratio of the distance $L_2$ from the first rotating portion 20 to the rocking portion 16 to the distance $L_1$ from the operation position 22*a* to the first rotating portion 20 be made as large as possible. Additionally, in order to make the rocking speed in the pressing portion 32 as high as possible, it is desirable that the ratio of the distance $L_4$ from the second rotating portion 30 to a position where the pressed portion 4*a* of the pressing portion 32 is pressed to the distance $L_3$ from the rocking portion 16 to the second rotating portion 30 be made as large as possible.

However, since the operating body 2 is required to have a certain degree of size for the rocking operation, and to secure a certain degree of radius of rotation from the operation position 22*a*, $L_1$ cannot be made so small. Additionally, in the switch device, there are also limitations to the dimensions in the height direction and the length direction. Thus, the position of the first rotating portion 20 of the operating body 2 and the pressing position of the switch element 4 cannot be moved much.

On the other hand, the rocking portion 16 can be formed at as lower a position as possible within a range of dimensional limitations of the switch device. Thereby, $L_2$ can be made as large as possible, $L_3$ can be made as small as possible, and the ratio of $L_2$ to $L_1$ can made large, the ratio of $L_4$ to $L_3$ can be made large, and the pressing speed of the switch element 4 by the pressing portion 32 to the operation speed at the operation position 22*a* of the operating body 2 can be set large.

Figure 3:
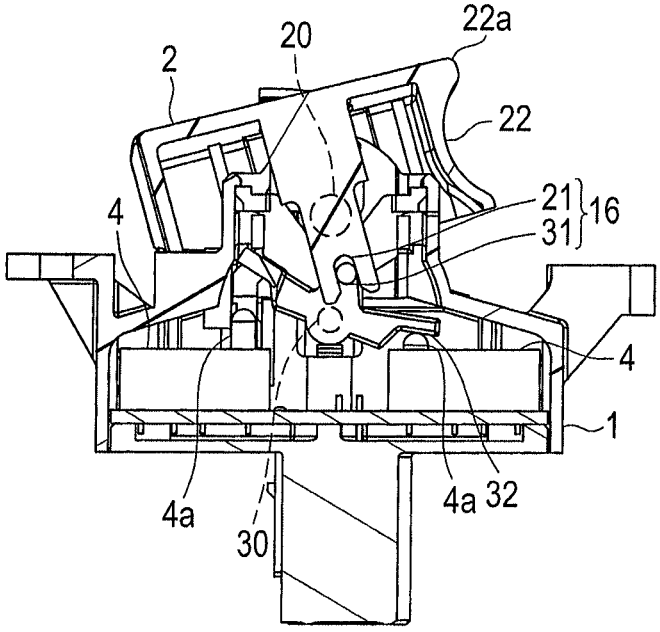
FIG. 3 is a cross-sectional view of the switch device when the operating body is rocked and operated.

A cross-sectional view of the switch device when the operating body 2 is rocked and operated is shown in FIG. 3. This drawing shows a state where a rocking operation is performed in a direction in which the operation position 22*a* of the operating body 2 is pulled upward. When the operating body 2 is rocked and operated, the operating body 2 is turned about the first rotating portions 20 with respect to the case 1, and with this turning, the holding portion 21 that constitutes the rocking portion 16 rocks the shaft portion 31. At this time, the shaft portion 31 also moves slightly in the longitudinal direction thereof with respect to the holding portion 21.

Since the driving body 3 is made rockable about the second rotating portions 30 with respect to the case 1, if the holding portion 21 rocks the shaft portion 31 in the rocking portion 16, the driving body tilts to the side opposite to the tilting direction of the operating body 2, and the pressing portions 32 presses the pressed portion 4*a* of the switch element 4.

When the operating body 2 is rocked and operated in a direction opposite to that of FIG. 3, that is, in a direction in which the operation position 22*a* is pushed in, the driving body 3 tilts in the direction opposite to that of FIG. 3, and the pressed portion 4*a* of the opposite switch element 4 is pressed by the pressing portion 32.

As such, the driving body 3 that is rocked by the rocking operation of the operating body 2 to press the switch element 4 is provided, and the rocking portion 16 that makes the operating body 2 and the driving body 3 rockable relative to each other is formed between the first rotating portion 20 that becomes the center of rotation of the operating body 2 with respect to the case 1 and the second rotating portions 30 that becomes the center of rotation of the driving body 3 with respect to the case 1. Thereby, the ratio of the pressing speed in the pressing portion 32 of the driving body 3 to the operation speed in the operation position 22*a* of the operating body 2 can be set using two ratios, that is, the ratio of $L_1$ and $L_2$, and the ratio of $L_3$ and $L_4$, and such a design that the pressing speed in the pressing portion 32 can be made as high as possible within limitations, such as the dimensions of the switch device, can be allowed.

Particularly by arranging the position of the rocking portion 16 at as lower a position as possible, the ratio of $L_2$ to $L_1$ can be made large, the ratio of $L_4$ to $L_3$ can be made large, and the pressing speed in the pressing portion 32 can be set large compared to the operation speed at the operation position 22*a* of the operating body 2. Thereby, when two contacts are placed side by side inside the switch element 4, the difference in the time taken when both contacts operate at the time of a pressing operation can be made small, and a reliable switching operation can be ensured.

Although a plurality of rotating and rocking portions is provided in the present embodiment, in these portions, the relationship between a protruding portion that comprise a rotating shaft and a hole portion that holds the protruding portion may be reversed. In the present embodiment, the first rotating portion 20 provided in the operating body 2 has a hole shape, and the case 1 is formed with the shaft portion 10*b* that journals the first rotating portion. However, the operating body 2 may be provided with the shaft portion, and the case 1 may be formed with the hole portion. Similarly, also as for the second rotating portions 30, the driving body 3 may be provided with the hole portion, and the case 1 may be provided with the shaft portion.

Similarly, also as for the rocking portion 16, the driving body 3 may be provided with the holding portion, and the operating body 2 may be provided with the shaft portion. Additionally, in the present embodiment, the holding portion 21 that constitutes the rocking portion 16 is formed as a substantially U-shaped slit. However, the holding portion 21 may be formed as arbitrary shapes as long as the holding portion can hold the shaft portion 31 while allowing it to rotate and slide, and can for example be formed in the shape of a long hole.

Although the embodiment of the present invention has been described hitherto, the present invention is not limited to the above embodiment in the application thereof, and may be variously applied within the scope of the technical idea of the present invention.

It should be understood by those skilled in the art that various modifications, combinations, sub-combinations and alterations may occur depending on design requirements and other factors insofar as they are within the scope of the appended claims of the equivalents thereof.

What is claimed is:

1. A switch device comprising:

a operating body held in a case and configured to be rockable;

a driving body held within the case and configured to be rockable by the operating body; and a switch element pressed by the driving body, wherein the rocking operating body is held with respect to the case by a first rotating portion disposed apart from a position where the operating body is operated, wherein the driving body is rockably mounted to the case by a second rotating portion disposed apart from a position where the driving body presses the switch element, and wherein the operating body and the driving body are rockable relative to each other around a rocking portion, the rocking portion being disposed between the first rotating portion and the second rotating portion and including a shaft portion and a holding portion, the shaft portion being formed in one of the operating body and the driving body, the holding portion being formed in the other one of the operating body and the driving body, the shaft portion being rotatable and slidable relative to the holding portion, and wherein the distance between the second rotating portion of the driving body and a position where the driving body presses the switch element is larger than the distance between the second rotating portion and the rocking portion.

2. The switch device according to claim 1, wherein the holding portion is formed in the shape of a substantially U-shaped slit.

3. The switch device according to claim 1, wherein the holding portion is formed in the shape of a long hole.

4. A switch device comprising:

a case;

an operating body rockably mounted to the case by a first rotating body;

a driving body rockably mounted to the operating body by a rocking portion and rockably mounted to the case by a second rotating portion, the rocking portion being disposed between the first rotating body and the second rotating body; and a switch element disposed under the driving body and selectively pressed by the driving body, wherein the rocking portion is disposed between the first rotating portion and the second rotating portion and includes a shaft portion and a holding portion, the shaft portion being formed in one of the operating body and the driving body, the holding portion being formed in the other one of the operating body and the driving body, the shaft portion being rotatable and slidable relative to the holding portion, and wherein when the operating body is in a neutral position, the first rotating portion, the second rotating portion, and the rocking portion are aligned along a straight line and when the operating body is titled to cause the driving body to press the switch element, the first rotating portion and the second rotating portion remain in the straight line and the rocking portion is moved away from the straight line.

* * * * *